United States Patent [19]

Yamauchi et al.

[11] 4,168,450

[45] Sep. 18, 1979

[54] SLOT TYPE SHADOW MASK

[75] Inventors: Masaaki Yamauchi, Togane; Katsuyoshi Tamura; Hiromi Kanai, both of Mobara, all of Japan

[73] Assignee: Hitachi, Ltd., Japan

[21] Appl. No.: 782,742

[22] Filed: Mar. 30, 1977

[30] Foreign Application Priority Data

Jul. 19, 1976 [JP] Japan ..... 51-85075

[51] Int. Cl.[2] ..... H01J 29/07

[52] U.S. Cl. ..... 313/403; 96/36.1

[58] Field of Search ..... 313/403, 408, 402

[56] References Cited

U.S. PATENT DOCUMENTS

| | | | |
|---|---|---|---|
| 2,792,521 | 5/1957 | Sziklai et al. | 313/471 X |
| 3,760,214 | 9/1973 | Yamazaki et al. | 313/403 |
| 3,882,347 | 5/1975 | Suzuki et al. | 313/403 |
| 3,947,718 | 3/1976 | Lent | 313/403 |

FOREIGN PATENT DOCUMENTS

| | | | |
|---|---|---|---|
| 2235904 | 2/1973 | Fed. Rep. of Germany | 313/403 |

*Primary Examiner*—Robert Segal

*Attorney, Agent, or Firm*—Craig and Antonelli

[57] ABSTRACT

A color picture tube is disclosed which comprises an electron gun for emitting an electron beam and a shadow mask including a plurality of slots and a plurality of bridges each interposed between adjacent slots along the longitudinal axis thereof. When X and Y axes are assumed passing through the central point of the surface of the shadow mask in the direction of horizontal deflection of the electron beam and passing through the same central point in the direction perpendicular to the X axis, respectively, the angle that each bridge forms with the X axis as viewed from the electron gun is determined in relation to the incident angle of the electron beam impinging upon the bridge, in accordance with the distance of the bridge from the X and Y axes.

5 Claims, 16 Drawing Figures

SLOT TYPE SHADOW MASK

The present invention relates to a color picture tube, or more in particular to a slot-type shadow mask effectively applied particularly to a color picture tube of the post-focusing (or mask-focusing) type.

The prior art and the present invention as well as the advantages of the latter will be described with reference to the accompanying drawings, in which.

Figure 8:
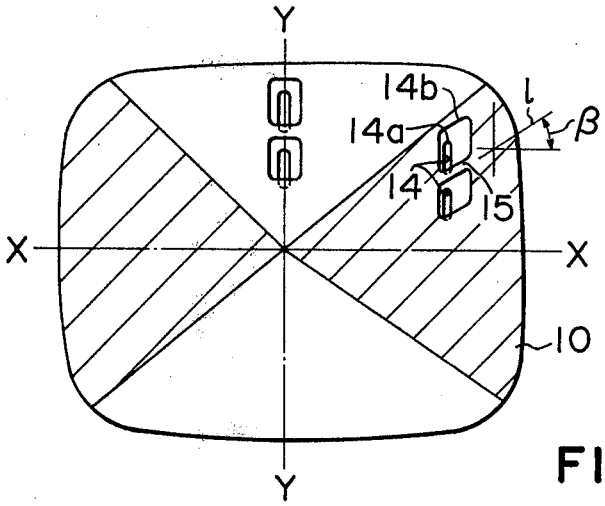
Figure 9:
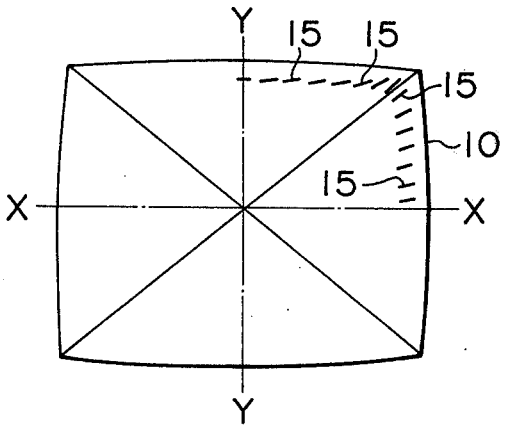
Figure 10:
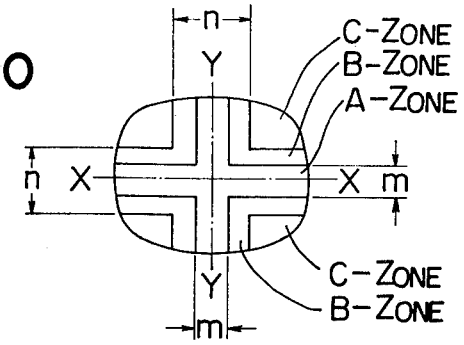
Figure 11:
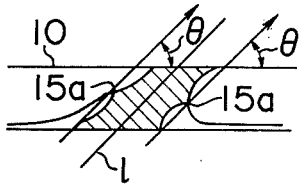
Figure 12:
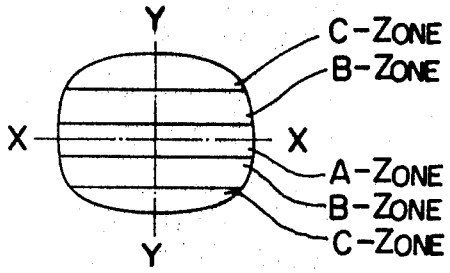
Figure 13A:
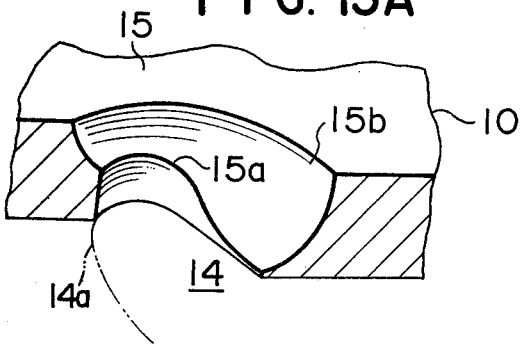
Figure 13B:
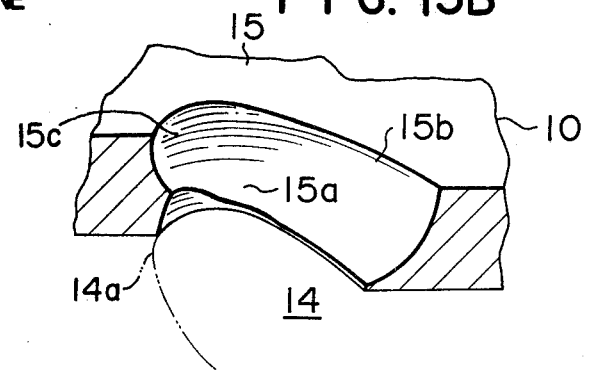
Figure 14:
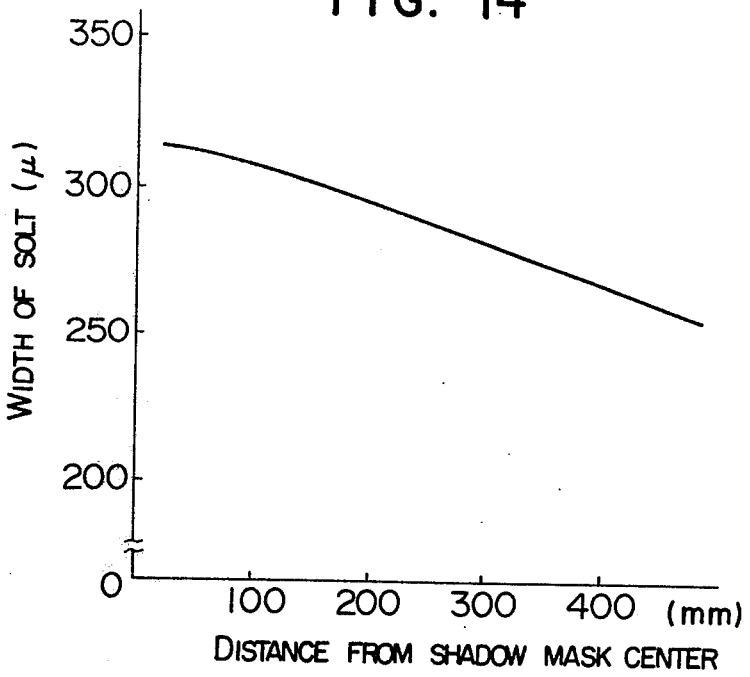
Figure 15:
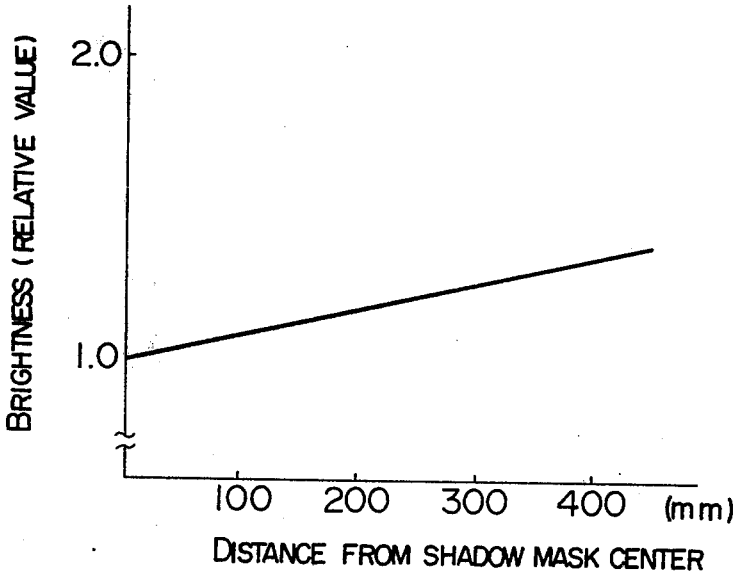

FIGS. 8 and 9 diagrammatically show the inclinations of the bridges of the shadow mask in the surface thereof according to the present invention;

FIG. 10 is a diagram for explaining that the inclinations of the shadow mask bridges according to the invention are changed stepwise in accordance with a plurality of regions of the surface of the shadow mask;

FIG. 11 is sectional view of the bridges taken along the longitudinal axes of the slots of the shadow mask according to the present invention;

FIG. 12 is diagram for explaining that the inclinations of the cross-sections of the shadow mask bridges according to the invention are changed stepwise in accordance with a plurality of regions of the surface of the shadow mask;

FIGS. 13A and 13B are diagrams for explaining the relation between the size of an opening of the slot of the shadow mask and a protrusion formed on the side wall of the slot;

FIG. 14 is a diagram for explaining the grading of the sizes of the slots of the slot-type shadow mask of the color picture tube of the post-focusing type; and FIG. 15 is a diagram showing the brightness of a reproduced image corresponding to the grading of FIG. 14.

Figure 1:
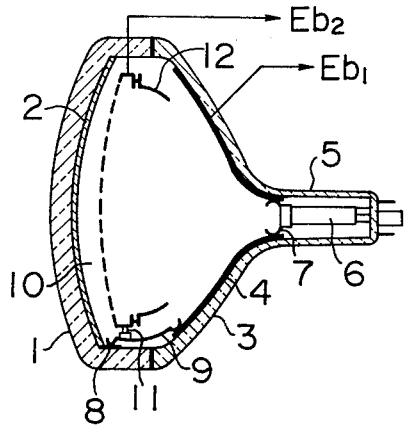
FIG. 1 is a diagram for explaining the construction of a color picture tube of the post-focusing (or mask-focusing) type.

The construction of a color picture tube of the double-high-voltage post-focusing (or mask-focusing) type is shown in FIG. 1. In the drawing, reference numeral 1 shows a panel comprised of a light-transmissible graphite strip film coated with phosphor materials in strips corresponding to red, blue and green. These phosphor strips are metal-backed making up a phosphor screen 2. The internal side of the funnel 3 is formed with an interior graphite film 4 which is supplied with a high voltage from an external source through a cavity cap not shown, so that a voltage is applied to an electron gun 6 disposed in the neck 5 through a contact spring 7 provided at the forward end of the electron gun 6. The electron gun 6 is of the well known multistage-focus type.

Further, the graphite film 4 and the phosphor screen 2 are electrically connected with each other through a conductive spring 9 and a conductive graphite film 8 electrically connected with the metallized backing, thereby applying a voltage to the phosphor screen 2. The conductive spring 9 is secured to a shadow mask 10 including a plurality of slots by means of a support 11 made of such an insulating material, such as glass.

The shadow mask 10 and a potential-correcting plate 12 are electrically connected to each other and are supplied with an additional high voltage through another conductive spring (not shown) from another cavity cap (not shown).

In a color picture tube of the post-focusing type having the construction as described above, the diameter of the electron beam emitted from the electron gun 6 is approximately 25% smaller than that of a BPF electron gun (bi-potential focus electron gun) because of the multistage-focus type. The electron beam is caused to scan by a deflection system not shown and causes the whole surface of the phosphor screen to illuminate through the slots of the shadow mask.

The electron gun 6, the graphite film 4 and the phosphor screen 2 are supplied with a voltage $Eb_1$ (for instance, 25 KV), while a voltage $Eb_2$ (say, 12.1 KV) is applied to the shadow mask 10 and the potential-correcting plate 12. The potential difference between $Eb_1$ and $Eb_2$ is provided for focusing the electron beams which pass through the shadow mask with a high beam transmissibility, in order to effectively increase the density of the electron beams impinging on the phosphors. Thus, by reducing the voltage of the shadow mask 10 as compared with that of the phosphor screen 2, it is possible in a color picture tube of the post-focusing type to obtain a reproduced image with brightness higher than that in an ordinary color picture tube other than the post-focusing type. An increased potential difference between shadow mask and phosphor screen increases the brightness, so that the effect of post-focusing increases the brightness up to a level 1.5 to 2 times that of an ordinary color picture tube. It is thus possible to attain a sufficiently visible image even in a bright environment such as in a very bright room.

The potential-correcting plate 12 is provided for regulating the electric field due to the potential difference between the graphite film 4 and the shadow mask 10 thereby to correct raster distortion. The electron gun of multistage focus type is used to compensate for deterioration in the focus of the electron beam which otherwise might occur due to an increased diameter of the electron beam which in turn is caused by the electric field attributable to the potential difference.

The electron beams that have passed through the slots of the shadow mask are focused and impinge on the phosphor screen. Secondary electrons are generated by the electrons impinging on the shadow mask. These secondary electrons, to which the potential energy of the phosphor screen is applied, cause an undesirable halation as they impinge on the phosphor screen, thus deteriorating color purity of a reproduced picture. In order to eliminate this disadvantage, graphite is coated on the shadow mask for reducing the emission of secondary electrons.

The voltage of the shadow mask which is lower than that of the phosphor screen, on the other hand, causes an undesirable bright spot on the phosphor screen which is produced by field emission due to the existence of protrusions such as burrs or dirt and/or any other material which will emit electrons at low energy. In the color picture tube of the post-focusing type, it is necessary to maintain the surface of the shadow mask in a better condition than an ordinary color picture tube other than the post-focusing type.

Figure 2:
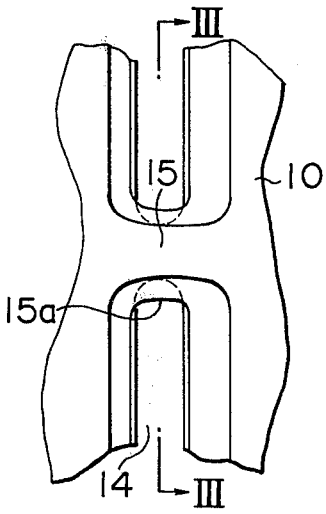
FIG. 2 PRIOR ART
FIG. 2 is a diagram partially showing the construction of the slots and bridges of a conventional slot-type shadow mask.
Figure 3:
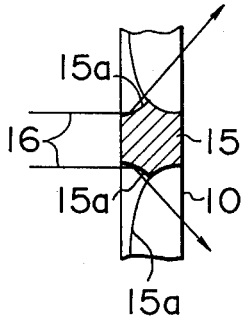
FIG. 3 PRIOR ART
FIG. 3 is a sectional view taken along line III—III in FIG. 2.
Figure 4:
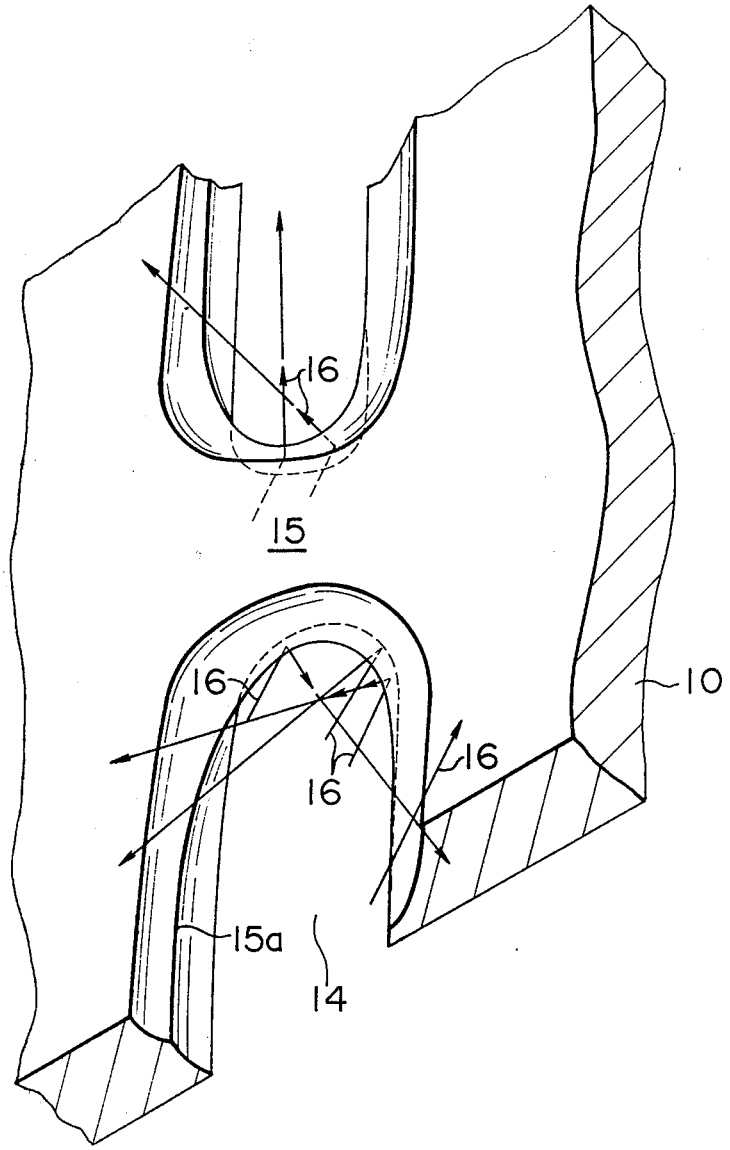
FIG. 4 PRIOR ART
FIG. 4 is a perspective view of the part shown in FIG. 2.

The color picture tube of the post-focusing type with a slot-type shadow mask has another problem. As shown in FIGS. 2, 3 and 4, the bridge 15 between the slots 14 of the slot-type shadow mask 10, along the longitudinal axis thereof, is unavoidably formed with a protrusion 15*a* in the etching process for formation of the slots. FIGS. 2 and 4 are diagrams showing the shadow mask as viewed from the phosphor screen 2. When an electron beam 16 impinges on the protrusion 15*a*, secondary electrons are generated. At the same time, the electron beam 16 is reflected. The secondary electrons and the reflected electrons impinge undesirably on the phosphors. As a result, undesirable illumination, that is, halation occurs, thereby deteriorating the contrast of a reproduced image on the color picture tube. This kind of halation is practically tolerable in an ordinary color picture tube other than the post-focusing type, and therefore a slot-type shadow mask is capable of being produced by an etching process which is industrially advantageous.

In the color picture tube of the post-focusing type with the shadow mask lower in voltage than the phosphor screen, however, the secondary electrons generated by the electron beam impinging on the protrusions 15*a* and the electron beam reflected, receiving energy from the electric field, cause great halation. Further, the reflection of the electron beam causes an undesirable ghosting, thereby greatly deteriorating the quality of the color picture tube.

These troublesome phenomena are not limited to a color picture tube of the post-focusing type but also occur, though to a lesser degree, in an ordinary color picture tube other than the post-focusing type.

The present invention has been made in view of the above-mentioned disadvantages of the prior art and an object thereof is to provide a slot-type shadow mask for a color picture tube, especially effectively used for a color picture tube of the post-focusing (or mask-focusing) type by which occurrence of halation or ghosting due to secondary electron emission or reflected electron beams is minimized.

According to one aspect of the invention, there is provided a color picture tube comprising an electron gun for producing an electron beam, and a slot-type shadow mask substantially rectangular as viewed from the electron gun, the shadow mask including a plurality of slots and a plurality of bridges each interposed between adjacent ones of the slots along the longitudinal axes thereof, wherein when an X axis passing through the central point of the surface of the shadow mask in the direction of horizontal deflection of the electron beam and a Y axis passing through the central point in the direction perpendicular to the X axis are assumed on the shadow mask, angles that the bridges in those of the regions defined by diagonal lines on the surface of the shadow mask which include the X axis form with the X axis are viewed from the electron gun are rendered substantially equal respectively to angles that the electron beams incident on the respective bridges, projected on the X-Y plane including the X and Y axes, form with the X axis, and angles that the bridges in those of the regions defined by the diagonal lines which include the Y axis form with the X axis as viewed from the electron gun are rendered substantially equal respectively to angles that the electron beams incident on the respective bridges, projected on the X-Y plane form with the X axis, in the neighborhood of the diagonal lines, the latter angles of said bridges being decreased progressively away from the diagonal lines toward the Y axis, to substantially zero on the Y axis.

According to another aspect of the invention, there is provided a color picture tube comprising an electron gun for producing an electron beam, and a slot-type shadow mask substantially rectangular as viewed from the electron gun, the shadow mask including a plurality of slots and a plurality of bridges each interposed between adjacent ones of the slots along the longitudinal axes thereof, wherein when X and Y axes passing through the central point of the surface of the shadow mask and in the direction of horizontal deflection of the electron beam and passing through said central point in the direction perpendicular to the X axis respectively are assumed on said shadow mask and the surface of the shadow mask is divided into a plurality of regions adjacent to each other in the direction away from the X and Y axes and having predetermined patterns symmetric with respect to the X and Y axes, angles that the bridges within each of the regions form with the X axis as viewed from the electron gun are rendered the same, said angles being rendered larger in the region farther from the X and Y axes.

The present invention will be explained in detail below with reference to the embodiments shown in the accompanying drawings.

Figure 5:
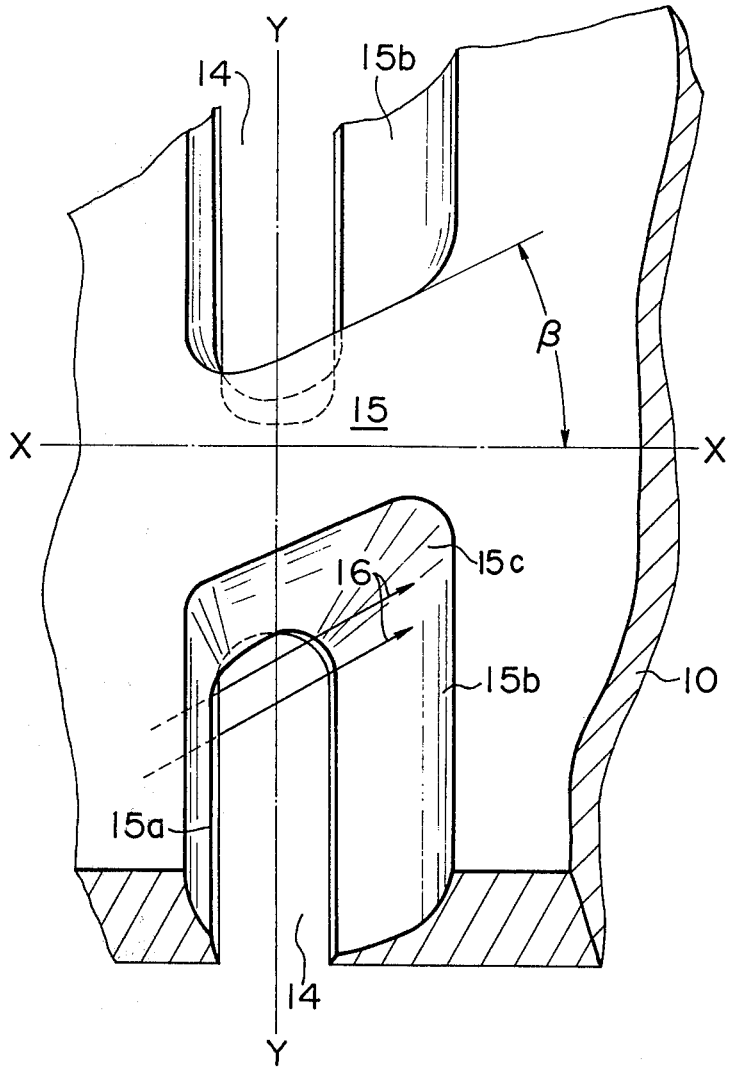
FIG. 5 is a diagram partially showing the construction of the slots and bridges of the slot-type shadow mask according to an embodiment of the present invention.
Figure 6:
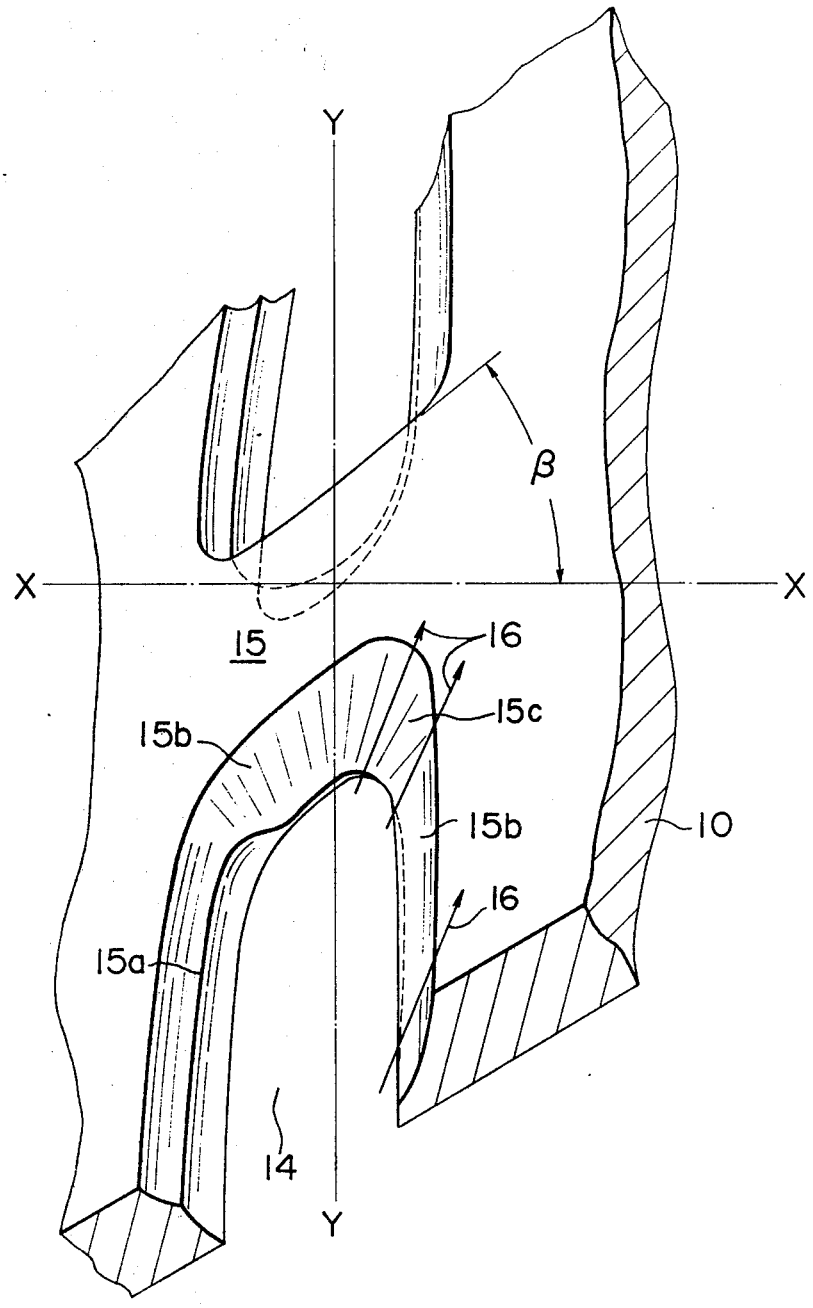
FIG. 6 is a perspective view of the part shown in FIG. 5.
Figure 7:
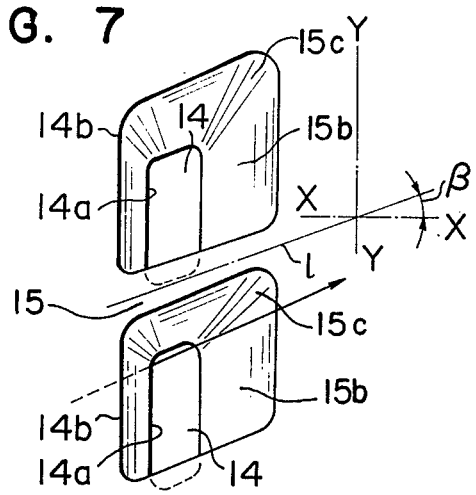
FIG. 7 is a diagram graphically showing the manner in which the slots of the slot-type shadow mask are etched according to the present invention.

A partial view of a slot-type shadow mask effectively used for a color picture tube of the post-focusing type as viewed from the phosphor screen, according to an embodiment of the present invention, is shown in FIG. 5. The shadow mask viewed obliquely from the lower right of FIG. 5 is shown in FIG. 6. An X axis passing through the central point of the surface of the shadow mask in the direction of the horizontal deflection of electron beams and a Y axis passing through the central point in the direction perpendicular to the X axis are assumed on the surface of the shadow mask. As illustrated in FIGS. 5 and 6, according to the present invention, the bridge 15 between adjacent slots 4 along the longitudinal axis is formed so as to be inclined substantially in parallel to the electron beam 16 impinging on this bridge as projected on the X-Y plane including the X and Y axes. In other words, the angle $\beta$ that the bridge 15 forms with the X axis is rendered substantially equal to the angle that the electron beam impinging on the bridge projected on the X-Y plane forms with the X axis. By thus determining the direction of each bridge, an undesirable protrusion capable of interrupting the course of the electron beams is not formed even when the slots 14 are formed by the conventional etching process. This is because, as shown in FIG. 6, the bridge 15 is formed at an angle to the X axis so that it is possible to provide a sufficiently large side-etched portion near the bridge or a corner portion 15*c* of the side-etched portion 15*b* in the etching process conducted from the front face or the phosphor screen side surface of the shadow mask. This is graphically shown in FIG. 7. In this drawing, numeral 14*a* shows openings of the slots 14 which are formed in the rear face or the electron gun side surface of the shadow mask, and numeral 14*b* openings of the slots 14 which are formed in the front face of the shadow mask. If a large side-etched portion would be produced without inclining the bridge 15, the side-etched portion 15*c* would reach an adjacent slot and cut into the birdge 15, with the result that a part of the bridge involved would be reduced in thickness thus decreasing the mechanical strength of the shadow mask.

The angle $\beta$ that each of the bridges forms with the X axis may be determined in the manner as mentioned above only within the range included in the shadowed parts defined by the diagonal lines of the shadow mask as shown in FIG. 8. It will be seen from FIG. 9 that, according as the location of bridges goes away from the X axis within that range, the angle that the electron beam projected on the X-Y plane forms with the X axis increases, and the angle $\beta$ may be increased. As to the bridges located in the regions not shadowed beyond the diagonal lines, however, the nearer the bridge is positioned to the Y axis, the smaller the angle $\beta$ is made.

This is because in the regions outside of the shadowed parts, if the angle $\alpha$ is increased with the angle that the electron beam projected on the X-Y plane forms with the X axis, the inclination of the bridge and thus the length of the bridge are increased progressively, thus reducing the strength of the shadow mask greatly. In an extreme case, the construction of a shadow mask is not attained on the Y axis. The bridges there, if any, would be long along the Y axis and cannot be called so any longer.

Actually, it is difficult to form by etching the slots with the angles $\beta$ continuously changed as described above. As a practical alternative, therefore, the surface of the shadow mask is divided into a plurality of zones or regions each symmetric with respect to the X and Y axes as shown in FIG. 10. The angles $\beta$ are changed stepwise for respective zones so that the angles $\beta$ are made to be constant angles different for respective zones. Preferably, the angle $\beta$ for each zone is the greatest one of the angles which would be included in the particular zone if progressively changed. For example, a shadow mask with three different angles $\beta$ in respective three zones of A, B and C on the surface of the mask as shown in FIG. 10 was sufficiently practically used. The angles $\beta$ for the respective zones in this case are shown in Table 1, for a color picture tube of 20 inches and 110° of deflection angle. In this case, the sizes m and n for the zones A and B are 10±2 mm and 102±5 mm respectively.

Table 1

| Zone | A | B | C |
|---|---|---|---|
| $\beta$ | 0° ± 1° | 19° + 5° −0° | 35° + 5° −0° |

In order to further improve the effect of the present invention, the protrusions 15*a* should desirably be formed in such a manner as to be hidden behind the bridges 15 as viewed from the electron gun. For lack of uniformity of the sizes of the protrusions 15*a*, however, it is difficult to hide the protrusions 15*a* completely as viewed from the electron gun. In order to hide the protrusion 15*a* from the electron gun as far as possible, therefore, it is necessary that the angle $\theta$ that the axis l of the cross-section of the bridge taken along the longitudinal axis of the slots 14 forms with the surface of the shadow mask be rendered substantially equal to the angle that the electron beam projected on a plane perpendicular to the X-Y plane and including the Y axis forms with the Y axis, as illustrated in FIG. 11.

It is also difficult to change the angle $\theta$ continuously in accordance with the incident angle of the electron beam. Therefore, as mentioned with reference to the angle $\beta$, the surface of the shadow mask should preferably be divided into a plurality of zones symmetric with respect to the X axis as shown in FIG. 12. The angles $\theta$ are changed stepwise for respective zones so that the angles $\theta$ are made to be constant angles different for respective zones. The number of divided zones may be determined optionally.

On and in the vicinity of the X axis, the angle $\beta$ of the bridge is very small and therefore the side-etched portion 15*c* of the slot cannot largely be obtained. Further, the angle $\theta$ is so large that it is impossible to hide the protrusion 15*a* sufficiently as viewed from the electron gun. So far as the protrusion 15*a* is formed, therefore, the electron beam will unavoidably impinge on the protrusion 15*a*. The halation caused by the impingement of the electron beam on the protrusion 15*a* is greater at a portion nearer the periphery of the shadow mask, i.e., farther from the Y axis. This is partly because the incident angle of the electron beam is larger at the periphery than the center of the shadow mask, and partly because the slot sizes are graded from the center toward the periphery of the shadow mask so that the center and the periphery have different side-etching factors for etching the slots. As a consequence, the protrusion 15*a* becomes larger at the periphery than at the center. In other words, design requirements for the shadow mask are that the openings of the slot formed in the front and rear faces of the shadow mask are larger and smaller respectively at a portion nearer to the periphery. In fabrication of the shadow mask by etching, therefore, the protrusion 15*a* is unavoidably larger in the periphery of the shadow mask due to different etching factors.

The inconveniences caused by the protrusions 15*a* on and in the vicinity of the X axis, particularly on and in the vicinity of X axis in the periphery of the shadow mask, may be eliminated practically by lessening the protrusion 15*a* as a result of enlarging the slot openings on the rear face of the shadow mask in consideration of the side-etching factor. In other words, as shown in FIG. 13A, the protrusion 15*a* formed by etching is large if the slot opening 14*a* on the rear face of the shadow mask 10 is small, while by increasing the size of the slot opening 14*a* as shown in FIG. 13B, the protrusion 15*a* is accordingly reduced in size, thereby reducing the chance of the electron beam impinging on the protrusion. In this way, by reducing the size of the protrusion 15*a* by enlarging the opening 14*a*, the transmissibility of the electron beam is increased, thereby increasing the brightness of a corresponding part of the reproduced image.

The grading of slot sizes for achieving the desired landing characteristic of the electron beam is shown in FIG. 14. The brightness of the reproduced screen attained by post-focusing, corresponding to such a grading, is shown in FIG. 15. In an ordinary color picture tube other than the post-focusing type, the brightness of a reproduced image in the periphery of the screen is 70 to 80% of that at the center thereof. Thus the reproduced image is brighter at the center than in the periphery. On the contrary, as seen in FIG. 15, in the color picture tube of the post-focusing type, a reproduced image is brighter in the periphery than at the center of the screen. If the slot opening 14*a* on the rear face of the shadow mask is enlarged to reduce the size of the protrusion 15*a*, therefore, the periphery of the reproduced image becomes even brighter. Although this appears to further adversely affect the uniformity of brightness of a reproduced image, the brightness of the screen is capable of being changed as required in design stage. For example, the uniformity of brightness of the screen may be assured simply by changing the light-transmissibility through adjustment of the size of the light-transmitting apertures of the graphite film which is a constituent member of the phosphor screen 2 (FIG. 1).

What we claim is:

1. A color picture tube comprising in an evacuated envelope, a phosphor screen, an electron gun for producing an electron beam, and a slot-type shadow mask which is substantially rectangular as viewed from said electron gun, said shadow mask including a plurality of slots and a plurality of bridges each interposed between adjacent ones of said slots along the longitudinal axes thereof, wherein when an X axis passing through the central point of the surface of said shadow mask in the direction of horizontal deflection of said electron beam and a Y axis passing through said central point in a direction perpendicular to said X axis are assumed on said shadow mask, the angles that said bridges, in those regions defined by diagonal lines on the surface of said shadow mask which include said X axis, form with said X axis, as viewed from said electron gun, are substantially equal respectively to the angles that the electron beams incident on said respective bridges, projected on the X-Y plane including said X and Y axis, form with said X axis, and the angles that said bridges, in those of said regions defined by said diagonal lines which include said Y axis, form with said X axis, as viewed from said electron gun, are substantially equal respectively to the angles that the electron beams incident on said respective bridges, projected on said X-Y plane, form with said X axis, in the vicinity of said diagonal lines, said latter angles of said bridges being decreased progressively away from said diagonal lines toward said Y axis, to substantially zero on said Y axis, the axis of the cross section of each of said bridges taken along the longitudinal axis of said slots being substantially parallel to the electron beam incident on each said bridge, projected on a plane including said Y axis and perpendicular to said X-Y plane.

2. A color picture tube according to claim 1, in which those openings of the slots located on and in the vicinity of said X axis which face said electron gun are larger in size than the openings, facing said electron gun, of the others of said slots located at points having the same distance from said central point as said slots located on and in the vicinity of said X axis.

3. A color picture tube comprising in an evacuated envelope, a phosphor screen, an electron gun for producing an electron beam, and a slot-type shadow mask of substantially rectangular form as viewed from said electron gun, said shadow mask including a plurality of slots and a plurality of bridges interposed between adjacent ones of said slots along the longitudinal axes thereof, wherein when an X axis passing through the central point of the surface of said shadow mask and a Y axis in the direction of horizontal deflection of said electron beam and passing through said central point in the direction perpendicular to said X axis are assumed on said shadow mask and the surface of said shadow mask is divided into a plurality of regions adjacent to each other in the direction away from said X and Y axes and having predetermined patterns symmetric with respect to said X and Y axes, the angles that said bridges within each of said regions form with said X axis as viewed from said electron gun are the same, said angles being larger in said region farther from said X and Y axes, the surface of said shadow mask being divided into a plurality of zones adjacent to each other in the direction away from said X axis and having predetermined patterns symmetric with respect to said X axis, the angles of the axes of the cross section of said bridges within each of said zones being the same and the last of said angles being rendered smaller in said zone farther from said X axis.

4. A color picture tube according to claim 3, in which said angle in the region farthest from said X and Y axes is rendered substantially equal to an angle that the electron beam incident on the bridge farthest from said X and Y axes, projected on the X-Y plane including said X and Y axes forms with said X axis, and said bridges are formed substantially in parallel to said X axis in that region of said regions which includes said X and Y axes.

5. A color picture tube according to claim 4, in which those openings of the slots located on and in the vicinity of said X axis which face said electron gun are larger in size than the openings, facing said electron gun, of the other slots located at points having the same distance from said central point as said slots located on and in the vicinity of said X axis.

* * * * *